United States Patent [19]

Breuker et al.

[11] 4,183,801

[45] Jan. 15, 1980

[54] PROCESS FOR PREPARING HYDROCARBONS

[75] Inventors: Jacobus H. Breuker; Hubertus N. H. DeHaan; Pieter B. Kwant, all of Amsterdam, Netherlands

[73] Assignee: Shell Oil Company, Houston, Tex.

[21] Appl. No.: 960,503

[22] Filed: Nov. 13, 1978

[30] Foreign Application Priority Data

Nov. 29, 1977 [NL] Netherlands ..... 7713122

[51] Int. Cl.[2] ..... C10G 13/02; C10G 37/02; C10G 23/02

[52] U.S. Cl. ..... 208/59; 208/14; 208/18; 208/89

[58] Field of Search ..... 208/59, 89, 14, 18

[56] References Cited

U.S. PATENT DOCUMENTS

| | | | |
|---|---|---|---|
| 3,804,742 | 4/1974 | Bennett et al. | 208/111 |
| 3,974,060 | 8/1976 | Voorhies et al. | 208/59 |
| 3,979,279 | 9/1976 | Yan | 208/264 |
| 3,992,283 | 11/1976 | Hutchings | 208/59 |
| 4,072,603 | 2/1978 | Wentzheimer | 208/264 |
| 4,120,778 | 10/1978 | Goudriaan | 208/80 |

FOREIGN PATENT DOCUMENTS

| | | |
|---|---|---|
| 2360379 | 6/1974 | Fed. Rep. of Germany . |
| 7216510 | 12/1972 | Netherlands . |

*Primary Examiner*—Delbert E. Gantz
*Assistant Examiner*—G. E. Schmitkons
*Attorney, Agent, or Firm*—Ronald R. Reper

[57] ABSTRACT

A process for preparing light distillate fractions and medicinal oil from heavy hydrocarbon oils comprises two-stage hydrocracking, fractionation distillation and catalytic hydrotreatment of at least part of the fractionation residue.

11 Claims, No Drawings

PROCESS FOR PREPARING HYDROCARBONS

BACKGROUND OF THE INVENTION

The invention relates to a process for preparing light hydrocarbon fractions and medicinal oil.

Light hydrocarbon fraction, such as naphtha and herosine, may be prepared by two-stage hydrocracking of heavy hydrocarbon oils, such as vacuum distillates of crude mineral oil, as described, e.g., in U.K. Pat. No. 1,400,013. To this end the heavy hydrocarbon oil is hydrocracked in the first stage, the hydrocracked product is separated by distillation into one or more light hydrocarbon fractions and a residue, the residue is hydrocracked in the second stage and the hydrocracked product from the second stage is also separated by distillation into one or more light hydrocarbon fractions and a residue. As a rule, the last-mentioned residue is used as a fuel oil component. The light hydrocarbon fractions separated in the distillation are the desired end product.

In this patent application the term medicinal oils is meant to denote hydrocarbon oils that are odorless and tasteless, which have a color lighter than Saybolt-Color Number +30 and which satisfy the hot acid test according to ASTM-D 565 and the requirement made by FDA No. 121.1146. In the hot acid test according to ASTM-D 565, the oil is treated with concentrated sulphuric acid. The two substances are heated and mixed. Two layers are formed then: an oil and an acid layer. The color of the two layers is tested. To satisfy this test the oil layer must not show any discoloration. The acid layer is allowed to show only little discoloration. This color must not become darker than a reference solution. The requirement made in FDA No. 121.1146 implies that the UV absorption of the oil in the wave-length range of 260–350 nm is at most 0.10. Medicinal oils are used on a large scale in the plastics, cosmetics, food and pharmaceutical industries. They are prepared, for instance, starting fro hydrocarbon fractions with suitable viscosities by treating these fractions successively with large amounts of concentrated sulphuric acid, neutralizing them and treating them with clay. This process has a number of drawbacks. The principal drawback is that of the waste products (acid tar and spent clay) obtained in the process. In connection with the tightening up of legislation concerning environmental hygiene, the disposal of these waste products, which are obtained in this process in considerable amounts, becomes an ever increasing problem. Another drawback of the above-mentioned process is its yield. Depending on the amount of undesired components present in the starting material and removed in the various stages of the refining process, the process may lead to a relatively low yield of medicinal oil. Finally, the process is rather expensive. In order to obviate the above-mentioned drawbacks in the preparation of medicinal oil, it was previously proposed to prepare these oils via a catalytic hydrotreatment, as described e.g. in Netherlands patent application No. 7216510. To this end a hydrocarbon fraction with a suitable viscosity is contacted with a catalyst at elevated temperature and pressure and in the presence of hydrogen. Since in this process the use of large amounts of concentrated sulphuric acid is obviated, and consequently also the formation of considerable amounts of acid tar, the problem of waste products hardly plays a role in this process. Since, furthermore, undesirable constituents present in the starting material are converted in this process into valuable medicinal oil components, instead of being removed from it, this process leads to a considerably higher yield of medicinal oil than the above-mentioned method of preparation using a treatment with a large amount of concentrated sulphuric acid. Finally, the process is considerably less expensive.

Applicants have carried out an investigation to examine to what extend residual fractions obtained in the distillation of the hydrocracked product from the second stage of the above-described two-stage hydrocracking process for the preparation of light hydrocarbon fractions from heavy hydrocarbon oils, can be used for the preparation of medicinal oils by catalytic hydrotreatment. It has been found that when these residual fractions were used as the feed, no medicinal oils could be prepared, not even when use was made of one of the most active catalysts known for the preparation of medicinal oils by hydrotreatment, namely a catalyst containing platinum on a carrier, which carrier consists of 13-15%w alumina, the rest being silica. Although with this catalyst it was possible to prepare, in high yield and under relatively mild conditions, oils that satisfied the requirements for medicinal oils as to taste, odor and color, the oils prepared did not satisfy the hot acid test according to ASTM-D 565 and/or the requirement according to FDA No. 121.1146. Attempts still to obtain a medicinal oil with this catalyst from this feed by increasing the temperature have remained unsuccessful. In addition to a loss in yield by cracking and a higher hydrogen consumption, the use of higher temperatures gave an increasing formation of structures that have an unfavorable effect on the results according to FDA test No. 121.1146 and the hot acid test according to ASTM-D 565.

Continued investigation concerning this subject by Applicants has shown that residual fractions obtained in the distillation of the hydrocracked product from the second stage of a two-stage hydrocracking process for the preparation of light hydrocarbon fractions from heavy hydrocarbon oils, can yet be used in certain cases as the feed for the preparation of medicinal oils by hydrotreatment across a catalyst comprising one or more noble metals of Group VIII on a carrier. For, it has surprisingly been found that in this way medicinal oils can be prepared in high yield from these residues, if the residues originate from the second stage of a hydrocracking process, in which instead of a distillation residue of the reaction product from the first stage, the whole reaction product from the first stage (without ammonia, hydrogen sulphide or light hydrocarbons formed being removed from it is used as the feed for the second stage. In addition to the fact that this embodiment of the two-stage hydrocracking process has the considerable advantage that a valuable product like medicinal oil can be prepared in high yield from a residual by-product having the value of fuel oil, this embodiment of the two-stage hydrocracking process allows the use of simpler equipment than in the procedure with distillation between the stages, because it requires much less fractionation capacity. This means that operation of this embodiment of the two-stage hydrocracking process can be less expensive.

SUMMARY OF THE INVENTION

The present patent application therefore relates to a process for preparing light hydrocarbon fractions and medicinal oil, in which a heavy hydrocarbon oil is hydrocracked in two stages using all of the reaction product from the first stage as the feed for the second stage, and in which the reaction product from the second stage is separated by distillation into one or more light hydrocarbon fractions and a residue and in which at least part of the residue is converted into medicinal oil by contacting it at elevated temperature and pressure and in the presence of hydrogen with a catalyst comprising one or more noble metals from Group VIII on a carrier.

DESCRIPTION OF PREFERRED EMBODIMENTS

In the process according to the invention a heavy hydrocarbon oil should be used as the feed. Suitable hydrocarbon oils are distillates or residues. Examples of suitable distillates are vacuum distillates of crude oils such as evaporation distillates. Examples of suitable residues are deasphalted atmospheric and vacuum residues of crude oils. Mixtures of distillates and residues are also suitable feeds for the process according to the invention. A very suitable feed of that type can be prepared by separating an atmospheric distillation residue of a crude oil by vacuum distillation into a vacuum distillate and a vacuum residue, deasphalting the vacuum residue, and mixing the deasphalted oil with the vacuum distillate, preferably in production ratio.

The process according to the invention is flexible to a high degree. Since the conversion of the residual fraction into medicinal oil takes place in a very high yield, the amount of medicinal oil obtained in the process is pre-eminently determined by the amount of residual fraction subjected to the catalytic hydrotreatment. The amount of medicinal oil is smaller according as more distillate is separated off in the distillation of the hydrocracked product from the second stage, and according as less of the remaining residue is used for the preparation of medicinal oil. If the distillation of the hydrocracked product from the second stage yields distillate fractions with an initial boiling point higher than the final boiling point of the heaviest end product fraction desired, these distillate fractions are preferably recycled to the hydrocracking unit. If only part of the residual fraction obtained in the distillation of the hydrocracked product from the second stage is used for the preparation of medicinal oil, the remaining part is preferably also recycled to the hydrocracking unit. The part of th residual fraction not used for the preparation of medicinal oil, can also very suitably be employed as blending component for fuel oil.

The process according to the invention is of special importance for the preparation of naphtha or kerosine as the main product and medicinal oil as the by-product. By the term naphtha is meant a hydrocarbon fraction with a boiling range between about 65 and 185° C. which is used, among other things, as a starting material for the preparation of motor gasolines and for the production of aromatics. By the term kerosine is meant a hydrocarbon fraction with a boiling range between about 150 and 300° C. which is used, among other things, as a starting material for the preparation of fuels for jet aircraft. If the process according to the invention is used for the preparation of naphtha with a boiling range of about 65–185° C., it is possible in the distillation of the hydrocracked product from the second stage to separate valuable light hydrocarbon fractions as by-products, such as a $C_3/C_4$ fraction and a $C_5-65°$ C. light gasoline fraction. If the process according to the inventio is used for the preparation of kerosine, it is possible, in the distillation of the hydrocracked product of the second stage, to separate one or more naphtha fractions as valuable by-products, in addition to the abovementioned light by-products.

In the process according to the invention hydrocracking is carried out in two stages. This is effected by contacting in the first stage the feed and in the second stage all of the reaction product from the first stage with a suitable hydrocracking catalyst at elevated temperature and pressure and in the presence of hydrogen. Examples of suitable catalysts for use in the first stage are weakly acid and moderately acid catalysts comprising one or more metals having hydrogenating activity on a carrier, such as fluorine-containing sulphidic, i.e. sulphided catalysts containing nickel and/or cobalt and, in addition, molybdenum and/or tungsten on alumina or amorphous silica-alumina as the carrier. Examples of suitable catalysts for use in the second stage are moderately acid and strongly acid catalysts comprising one or more metals haing hydrogenating activity on a carrier, such as fluorine-containing sulphided catalysts containing nickel and/or cobalt and, in addition, molybdenum and/or tungsten or amorphous silica-alumina; sulphided catalysts containing or not containing fluorine which contain nickel and/or cobalt and, in addition, molybdenum and/or tungsten on crystalline silica-alumina as the carrier; and catalysts containing or not containing fluorine, comprising one or more noble metals from Group VIII, particularly palladium, on crystalline silica-alumina. A catalyst combination which is preferred i the process according to the invention is a sulphidic, i.e. sulphided, fluorine- and phosphorus-containing nickel-molybdenum catalyst on alumina as the carrier as the catalyst for the first stage, and a sulphidic nickel-tungsten catalyst on a zeolite Y with a low sodium content as the carrier as the catalyst for the second stage. Suitable conditions for carrying out the hydrocracking process are a temperature in the range from about 250 to about 450° C., a pressure in the range from about 50 to about 200 bar, a space velocity in the range from about 0.2 to about 5 $l.l^{-1}.h^{-1}$ and a hydrogen/oil ratio in the range from about 500 to 3000 $Nl.kg^{-1}$. Hydrocracking is preferably carried out under the following conditions: a temperature in the range fro about 300 to about 425° C., a pressure in the range from about 75 to 175 bar, a space velocity in the range from aout 0.5 to about 3 $l.l^{-1}.h^{-1}$ and a hydrogen/oil ratio in the range from about 750 to 2500 $Ml.kg^{-1}$. Before the hydrocracked product of the second stage is separated by distillation into one ore more light hydrocarbon fractions and a residual fraction, a hydrogen-containing gas is separated from it. This gas is preferably recycled, after purification, to the hydrocracking unit.

If the residual fraction which is the starting material in the process according to the invention for the preparation of a medicinal oil by catalytic hydrotreatment, has a high wax content, whereas a medicinal oil with a low pour point is desired, a dewaxing treatment should be carried out. This treatment can be applied to the residual fraction or to the medicinal oil prepared from it. The dewaxing treatment can be carried out by cooling the oil in the presence of a solvent. Very suitable for our purpose is a mixture of methyl ethyl ketone and toluene, a temperature between −10 and −40° C. and a solvent to oil volume ratio between 1:1 and 10:1. The dewaxing treatment is preferably applied to the part concerned of the residual fraction before the catalytic hydrotreatment. The wax separated off can be processed separately, but can also very suitably be recycled to the hydrocracking process.

In the process according to the invention the preparation of the medicinal oil is effected by contacting a residual fraction of the hydrocracked product from the second stage at elevated temperature and pressure and in the presence of hydrogen with a catalyst comprising one or more noble metals from Group VIII on a carrier. The amount of noble metal of Group VIII present on the carrier may vary within wide limits, but often lies in the range of from 0.05 to 5%w. The noble metals of Group VIII which may be present on the carrier are: platinum, palladium, rhodium, ruthenium, iridium and osmium, with platinum as the preferred metal. If desired, two ore more of these metals may be present in the catalysts. The amount of the noble metal of Group VIII present in the catalyst is preferably from 0.1 to 2% w and particularly from 0.2 to 1%w. Examples of suitable carriers for the noble metal catalysts are amorphous oxides of the elements of Groups II, III and IV, such as silica, alumina, magnesia, zirconia, thoria and boria and mixtures of these oxides, such as silica-alumina, silica-magnesia and silica-zirconia. Preferred carriers for the noble metal catalysts are alumina and silica-alumina. A very suitable noble metal catalyst for the present purpose is a catalyst comprising one or more noble metals from Group VIII on a carrier, which carrier consists of 13–15%w alumina, the rest being silica.

Suitable conditions for carrying out the catalytic hydrotreatment for the preparation of medicinal oil according to the invention are: a temperature in the range from about 175° to 325° C., a hydrogen partial pressure in the range from about 10 to 250 bar, a space velocity in the range from about 0.1 to 5 $kg.l^{-1}.h^{-1}$ and a hydrogen/oil ratio in the range from about 100 to 5000 $Nl.kg^{-1}$. The catalytic hydrotreatment is preferably carried out under the following conditions: a temperature in the range from about 200° to 300° C., a hydrogen partial pressure in the range from about 25 to 200 bar, a space velocity in the range from about 0.25 to 2 $kg.l^{-1}.h^{-1}$ and a hydrogen/oil ratio in the range from about 250 to 2500 $Nl.kg^{-1}$.

The invention will now be further elucidated by the following example.

EXAMPLE

A distillate hydrocarbon fraction obtained in the vacuum distillation residue of a crude oil originating from the Middle East was used as the feed for two-stage hydrocracking experiments for the preparation of 370° C.− distillate. The two hydrocracking experiments were carried out at a temperature of 375° C., a pressure of 130 bar, a space velocity of 1.0 $l.l^{-1}.h^{-1}$ and a $H_2$/oil ratio of 1500 $Nl.kg^{-1}$ and using a sulphidic fluorine- and phosphorus-containing nickel-molybdenum catalyst on alumina as the carrier in the first stage, and at a pressure of 130 bar and a $H_2$/oil ratio of 1500 $Nl.H_2.kg^{-1}$ and using a sulphidic nickel-tungsten catalyst on zeolite Y with a low sodium content in the second stage. In both hydrocracking experiments a 370° C.+ residue was separated off by atmospheric distillation of the reaction product from the second stage. Both residues were dewaxed by cooling at −20° C. in the presence of a mixture of methyl ethyl ketone and toluene. The dewaxed products were divided into three portions of the same composition; each portion was subjected to a catalytic hydrotreatment (Experiments 3–8) at a pressure of 150 bar and a $H_2$/oil ratio of 600 $Nl.kg^{-1}$ and using a platinum catalyst on a carrier which consisted of 14.6% w alumina and 85.4% w silica. After removal of light products formed, the 370° C.+ fractions of the products treated with hydrogen were investigated for their suitability as medicinal oil. The vacuum distillate used as the feed for the hydrocracking experiments had the following properties:

initial boiling point:370° C.,
10% v boiling above 525° C.,
nitrogen content:920 ppmw, and
H/C weight.ratio:0.143.

HYDROCRACKING EXPERIMENT 1

In this experiment all of the reaction product from the first stage (without $NH_3$, $H_2S$ or light products being removed) was used as the feed for the second stage, which was carried out at a temperature of 362° C. and a space velocity of 1.2 $l.l^{-1}.h^{-1}$. A 370° C.+ residue was separated by distillation from the reaction product from the second stage, which residue had the following properties:

10% v boiling above 525° C.,
nitrogen content : 3 ppmw,
H/C weight ratio : 0.168, and
pour point : +30° C.

With 100 parts by weight of vacuum distillate as the feed 10 parts by weight of this 370° C.+ residue were obtained. After dewaxing this residue had the following properties:

nitrogen content:4 ppmw,
pour point point:−12° C.,
aromatics content:7.0 mmol/100 g. and
kinematic viscosity at 100° F.:45.0 cSt.

This product was divided into three portions of the same composition and each portion was subjected to a catalytic hydrotreatment (Experiments 3–5).

HYDROCRACKING EXPERIMENT 2

In this experiment a 370° C.+ residue was separated by distillation from the reaction product from the first stage, which residue was used as the feed for the second stage, which was carried out at a temperature of 368° C. and a space velocity of 1.4 $l.l^{-1}.h^{-1}$. A 370° C.+ residue was separated by distillation from the reaction product from the second stage, which residue had the following properties:

10% v boiling above 492° C.,
nitrogen content:1.5 ppmw,
H/C weight ratio:0.165, and
pour point:+30° C.

With 100 parts by weight of vacuum distillate as the feed, 9 parts by weight of this 370° C.+ residue were obtained. After dewaxing this residue had the following properties:

nitrogen content:2 ppmw,
pour point:−12° C.,
aromatics content:9.2 mmol/100 g, and
kinematic viscosity at 100° F.:44.2 cSt.

This product was divided into three portions of the same composition and each portion was subjected to a catalytic hydrotreatment (Experiments 6–8).

The properties of the products obtained by catalytic hydrotreatment, which products were all tasteless and odorless, are given in the following table.

Table

| Hydrotreatment, Exp. No. | 3 | 4 | 5 | 6 | 7 | 8 |
|---|---|---|---|---|---|---|
| Feed for hydrotreatment originating from hydrocracking experiment No. | 1 | 1 | 1 | 2 | 2 | 2 |
| Temperature during the hydrotreatment, °C. | 260 | 280 | 280 | 260 | 280 | 300 |
| Space velocity during the hydrotreatment, $l.l^{-1}.h^{-1}$ | 0.5 | 0.75 | 0.5 | 0.5 | 0.5 | 0.5 |
| Yield of 370° C.+ product in the hydrotreatment, % | 99 | 99 | 98 | 99 | 98 | 82 |
| Properties of the 370° C.+ *product obtained* in the hydrotreatment | | | | | | |
| kinematic viscosity at 100° F., cSt | 44.8 | 43.3 | 43.0 | 43.7 | 42.0 | 36.5 |
| aromatics content, mmol/100 g | 0.25 | 0.15 | 0.08 | 6.3 | 3.5 | 1.7 |
| color Saybolt | +30 | +30 | +30 | +30 | +30 | +30 |
| result hot acid test | + | + | + | − | − | − |
| result FDA test No. 121.1146 | + | + | + | − | + | − |

Experiments 3–5 are experiments according to the invention. In these experiments oils were obtained which fully satisfied the requiremenrts made for medicinal oils in this patent application. Experiments 6–8 are outside the scope of the invention. In these experiments oils were obtained which, as regards their behavior in the hot acid test, did not satisfy the requirements made for medicinal oils in this patent application in any case and, as regards their behavior in the FDA test No. 121.1146, did not do so in two cases.

What we claim is:

1. A process for preparing light hydrocarbon fractions and medicinal oil from a heavy hydrocarbon oil which comprises:

(a) hydrocracking said heavy hydrocarbon oil feed in a first stage at an elevated temperature and pressure and in the presence of hydrogen over a weakly or moderately acidic catalyst comprising one or more metals having hydrogenating activity on a carrier and passing the total reaction product to a second hydrocracking stage, (b) hydrocracking said product from step (a) at an elevated temperature and pressure and in the presence of hydrogen over a moderately or strongly acidic catalyst comprising one or more metals having hydrogenating activity on a carrier, and (c) separating the reaction product from step (b) by fractionation distillation into at least one light distillate hydrocarbon fraction and a residue, and (d) converting at least part of said residue into medicinal oil by contacting said residue at an elevated temperature and pressure and in the presence of hydrogen with a catalyst comprising at least one noble metal of Group VIII on a carrier.

2. A process according to claim 1, wherein the heavy hydrocarbon oil feed for step (a) is selected from vacuum distillates of crude oils, deasphalted atmospheric or vacuum residues of crude oils and mixtures thereof.

3. A process according to claim 2, wherein the heavy hydrocarbon oil feed for step (a) has been prepared by separating an atmospheric distillation residue of a crude oil by vacuum distillation into a vacuum distillate and a vacuum residue, deasphalting the vacuum residue, and mixing the deasphalted oil with the vacuum distillate in production ratio.

4. A process according to claim 1 wherein distillate fractions obtained in step (c), which have an initial boiling point higher than the final boiling point of the heaviest end product fraction desired, are recycled to step (a).

5. A process according to claim 1, wherein in step (a) the hydrocracking is carried out using a sulphidic fluorine and phosphorus-containing nickel-molybdenum catalyst on alumina as the carrier and a sulphidic nickel-tungsten catalyst on a zeolite Y with a low sodium content as the carrier in the second stage.

6. A process according to claim 1, wherein the hydrocracking is carried out at a temperature of from 250° to 450° C., a pressure of from 50 to 200 bar, a space velocity of from 0.2 to 5 $l.l^{-1}.h^{-1}$ and a hydrogen/oil ratio of from 500 to 3000 $Nl.kg^{-1}$.

7. A process according to claim 1, wherein a dewaxing treatment is applied to the part of the residual fraction from which the medicinal oil is prepared intermediate to steps (c) and (d).

8. A process according to claim 1, wherein in step (d) the catalytic hydrotreatment of the residual fraction for the preparation of medicinal oil is carried out using a catalyst which contains from 0.05 to 5% w of at least one noble metal from Group VIII on a carrier.

9. A process according to claim 8, wherein the catalyst contains from 0.1 to 2% w noble metal of Group VIII.

10. A process according to claim 8 or 9, wherein the catalyst carrier consists of 13–15% w alumina, the rest being silica.

11. A process according to any one of claims 1–10, wherein in step (d) the catalytic hydrotreatment of the residual fraction for the preparation of medicinal oil is carried out at a temperature of from 175° to 325° C., a pressure of from 10 to 250 bar, a space velocity of from 0.1 to 5 $kg^{-1}.h^{-1}$ and a hydrogen/oil ratio of from 100 to 5000 $Nl.kg^{-1}$.

* * * * *